US008496306B2

(12) United States Patent
Chen et al.

(10) Patent No.: US 8,496,306 B2
(45) Date of Patent: Jul. 30, 2013

(54) OPENING MECHANISM OF SLIDE ASSEMBLY

(75) Inventors: Ken-Ching Chen, Kaohsiung (TW); Yi-Syuan Jhao, Kaohsiung (TW); Chun-Chiang Wang, Kaohsiung (TW)

(73) Assignee: King Slide Works Co., Ltd., Kaohsiung (TW)

( * ) Notice: Subject to any disclaimer, the term of this patent is extended or adjusted under 35 U.S.C. 154(b) by 205 days.

(21) Appl. No.: 13/174,889

(22) Filed: Jul. 1, 2011

(65) Prior Publication Data

US 2013/0004101 A1 Jan. 3, 2013

(51) Int. Cl.
*A47B 88/04* (2006.01)

(52) U.S. Cl.
USPC ..... 312/333; 312/319.1

(58) Field of Classification Search
USPC ..... 312/319.1, 330.1, 333, 334.1, 334.7, 312/334.8, 334.11, 334.44, 334.46, 334.47; 384/21, 22
See application file for complete search history.

(56) References Cited

U.S. PATENT DOCUMENTS

| | | | | |
|---|---|---|---|---|
| 5,040,833 | A | 8/1991 | Brunnert | |
| 7,347,515 | B1 | 3/2008 | Lu | |
| 7,374,261 | B1 | 5/2008 | Wang | |
| 7,413,270 | B2 | 8/2008 | Chang et al. | |
| 7,537,296 | B2 | 5/2009 | Leon et al. | |
| 2003/0001472 | A1* | 1/2003 | Kim et al. | 312/334.46 |
| 2008/0197759 | A1* | 8/2008 | Chen et al. | 312/334.1 |
| 2011/0043087 | A1* | 2/2011 | Shih et al. | 312/334.1 |
| 2011/0129172 | A1* | 6/2011 | Liang et al. | 384/22 |
| 2011/0235952 | A1* | 9/2011 | Chen et al. | 384/7 |

FOREIGN PATENT DOCUMENTS

| | | | |
|---|---|---|---|
| EP | 0743032 | B1 | 11/1996 |

* cited by examiner

*Primary Examiner* — James O Hansen
*Assistant Examiner* — Sasha T Varghese
(74) *Attorney, Agent, or Firm* — Rosenberg, Klein & Lee

(57) ABSTRACT

The opening mechanism includes a fixing member, a movable member, a locking member, a first resilient member and a second resilient member. The fixing member is fixed to a first rail and has a guide portion, a stop and a room. The movable member is movably connected to the fixing member and has a first leg, a second leg and an engaging portion. The first leg slidably contacts the guide portion and the second leg extends into the room. The locking member is pivotably connected to a second rail and includes a locking portion. The first and second resilient members respectively provide a force to a third rail and the movable member. When the second rail is forcibly pulled out relative to the first rail, the movable member is moved and pivots at an angle so that the locking portion is disengaged from the engaging portion.

5 Claims, 10 Drawing Sheets

OPENING MECHANISM OF SLIDE ASSEMBLY

FIELD OF THE INVENTION

The present invention relates to an opening mechanism of a slide assembly, and more particularly, to an opening mechanism to protect the parts of the slide assembly from being damaged when the slide assembly is forcibly opened from its retracted position.

BACKGROUND OF THE INVENTION

U.S. Pat. No. 5,040,833 to Brunnert discloses a "closing device for a drawer" and includes a drawer installed to a piece of furniture and the drawer is movable between a closed position and an opened position on the piece of furniture. A spring is located between the drawer and the piece of the furniture. A closing device is connected to the piece of the furniture and includes a holding member which has a hook-shaped end. A latch member is connected to the drawer. When the drawer is located at the closed position, the latch member is engaged with the hook-shaped end of the holding member. The latch member has at least one raised area which has at least two guide tracks for guiding the holding member. When the drawer is movable between the closed and opened positions, the holding member is guided by the two different guide tracks and bent. When the drawer is pulled out from the piece of the furniture improperly, the upward deformation of the holding member makes the hook-shaped end be disengaged from the latch member. When a force pushes the drawer which is at its closed position, the hook-shaped end of the holding member is movable and disengaged from the latch member, so that the drawer pops out from the piece of the furniture in response to the force of the spring.

U.S. Pat. No. 7,374,261 to Wang discloses a "push-open type slide structure" and includes a top fastener and a locking device between an outer slide rail and a pull rod. The loading plate is extended from one side of the center portion of the main body. Two pillars are extended from both sides of the main body. A positioning fastener is coupled with the loading plate. A hook is mounted on the inner edge of the loading plate. A guide pillar is mounted on the rear end of the loading plate. The hook is inserted into the action trench of the main body and coupled with the elastic device. The locking device has a connection part for coupling with a guide part and a shaft holder. The push-open type slide structure is lockable or unlockable by pivotal rotation between the loading plate and the locking device.

Besides, a protection device is disclosed by Brunnert and Wang so as to protect the parts when the drawer is forcibly pulled out. Brunnert uses the holding member which is deformed upward so that the hook is disengaged from the latch member. Wang discloses a slot defined in the loading plate and the slot is located corresponding to the underside of the pillar such that the end with the pillar of the positioning fastener can be deformed so that the pillar can be removed from the locking device. However, both of the two protections are functioned by the deformation of the related parts to release the engagement. Nevertheless, the contact portions between two parts tend to be worn out after several times of operation so that the life of use is shortened. Besides, in order to allow the deformed part to bounce back, the portion that is deformed cannot be too stiff, accordingly, the response force to bear the force pulling the drawer out from the rails is weak. The structure cannot be used for a large drawer or heavy duty slide assembly because the drawer could open unexpectedly.

The present invention intends to provide an opening mechanism for a slide assembly and the opening mechanism improves the shortcomings of the conventional structures mentioned above.

SUMMARY OF THE INVENTION

The present invention relates to an opening mechanism of a slide assembly which comprises a first rail, a second rail and a third rail. The opening mechanism comprises a fixing member fixed to the first rail and the fixing member has a guide portion, a stop and a room. The guide portion has a longitudinal guide section and a bent section which is located at the front end of the longitudinal guide section. The stop is located at the rear end of the longitudinal guide section. The room is substantially parallel to the longitudinal guide section. A movable member is movably connected to the fixing member and has a first leg, a second leg, a guide path and an engaging portion. The first leg slidably contacts the guide portion of the fixing member. The second leg extends into the room of the fixing member. The guide path has a first longitudinal groove, a second longitudinal groove and a passage. The first longitudinal groove and the second longitudinal groove are located on two sides of the engaging portion. The passage communicates with the first and second longitudinal grooves and is located corresponding to the engaging portion. A locking member is pivotably connected to the second rail which is longitudinally and slidably movable relative to the first rail. The locking member has a locking portion which contacts the engaging portion of the movable member when the second rail is located at a retracted position relative to the first rail. A first resilient member provides a force in a first direction and is applied to the third rail which is slidably connected between the first and second rails. A second resilient member provides a force in a second direction and is applied to the movable member. The second direction is opposite to the first direction. The force of the second resilient member is larger than that of the first resilient member.

When the locking portion of the locking member is engaged with the engaging portion of the movable member, the first resilient member provides the force in the first direction to the third rail which stores a force for popping outward relative to the first rail. The second resilient member provides the force in the second direction to the movable member which contacts the stop of the fixing member.

When the second rail is forcibly pulled out relative to the first rail, the first leg of the movable member is moved along the longitudinal guide section of the guide portion of the fixing member. The second leg of the movable member moves in the room of the fixing member so as to push the second resilient member. When the movable member is moved to the front end of the longitudinal guide section, the first leg slides in the bent section at the front end of the longitudinal guide section and pivots at an angle so that the locking portion of the locking member is disengaged from the engaging portion of the movable member. The second resilient member generates a compression force which is applied to the movable member.

Preferably, the first leg and the second leg are located at the bottom of the movable member, and the guide path and the engaging portion are located on the top of the movable member.

Preferably, the first resilient member is mounted to a fixing rod, and two ends of the first resilient member respectively contact a head of the fixing rod and a push member mounted to the fixing rod. The push member is slidably connected to the fixing member and contacts the third rail.

Preferably, the second resilient member is located in the room of the fixing member, and two ends of the second resilient member respectively contact an inner wall of the room and the second leg of the movable member. The movable member contacts the stop of the fixing member by the force of the second resilient member.

Preferably, the movable member has a protrusion and the second rail has a contact portion which is located corresponding to the protrusion. When the protrusion is pushed by the contact portion, the movable member is moved and the first leg is disengaged from the bent section of the fixing member.

The primary object of the present invention is to provide an opening mechanism of a slide assembly so as to protect the parts of the slide assembly from being damaged when the slide assembly is improperly opened.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
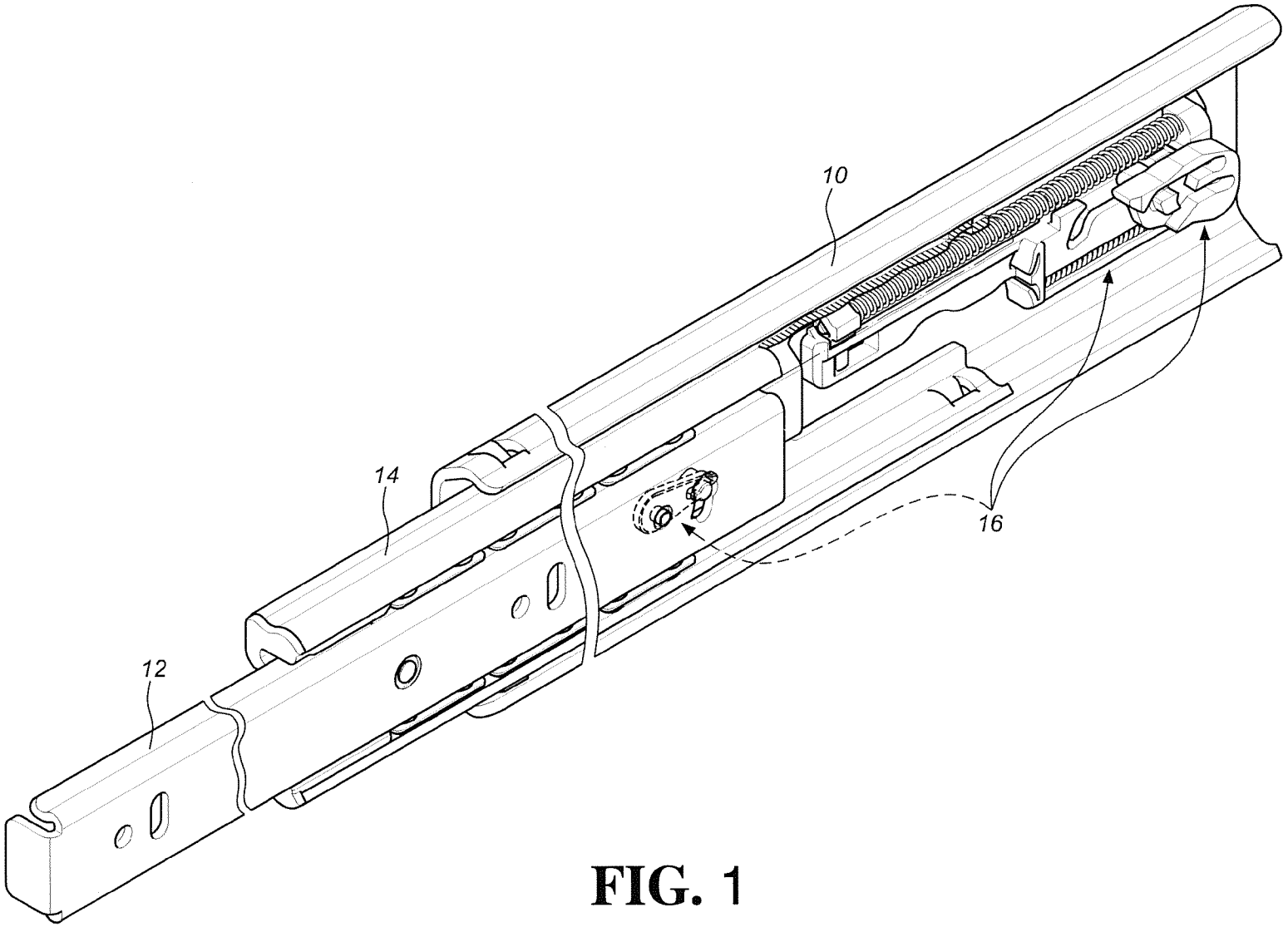
FIG. 1 is a perspective view to show the slide assembly with the opening mechanism of the present invention.

Referring to FIG. 1, the slide assembly comprises a first rail 10, a second rail 12 which is longitudinally and slidably movable relative to the first rail 10, and a third rail 14 which is longitudinally and slidably connected between the first and second rails 10 and 12. The second rail 12 is pulled to a further distance relative to the first rail 10 by the third rail 14.

Figure 2:
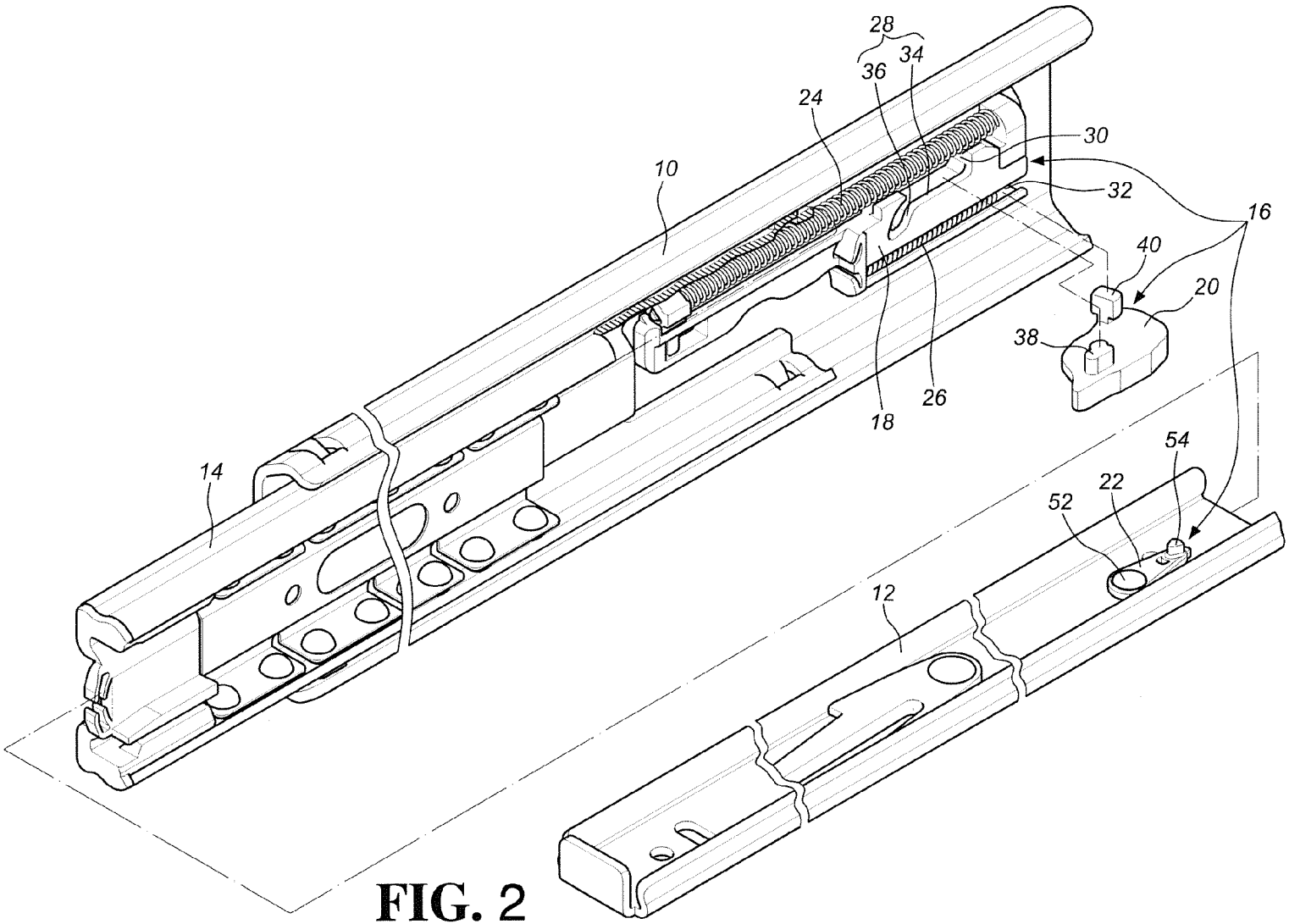
FIG. 2 is an exploded view to show the opening mechanism of the present invention.
Figure 3:
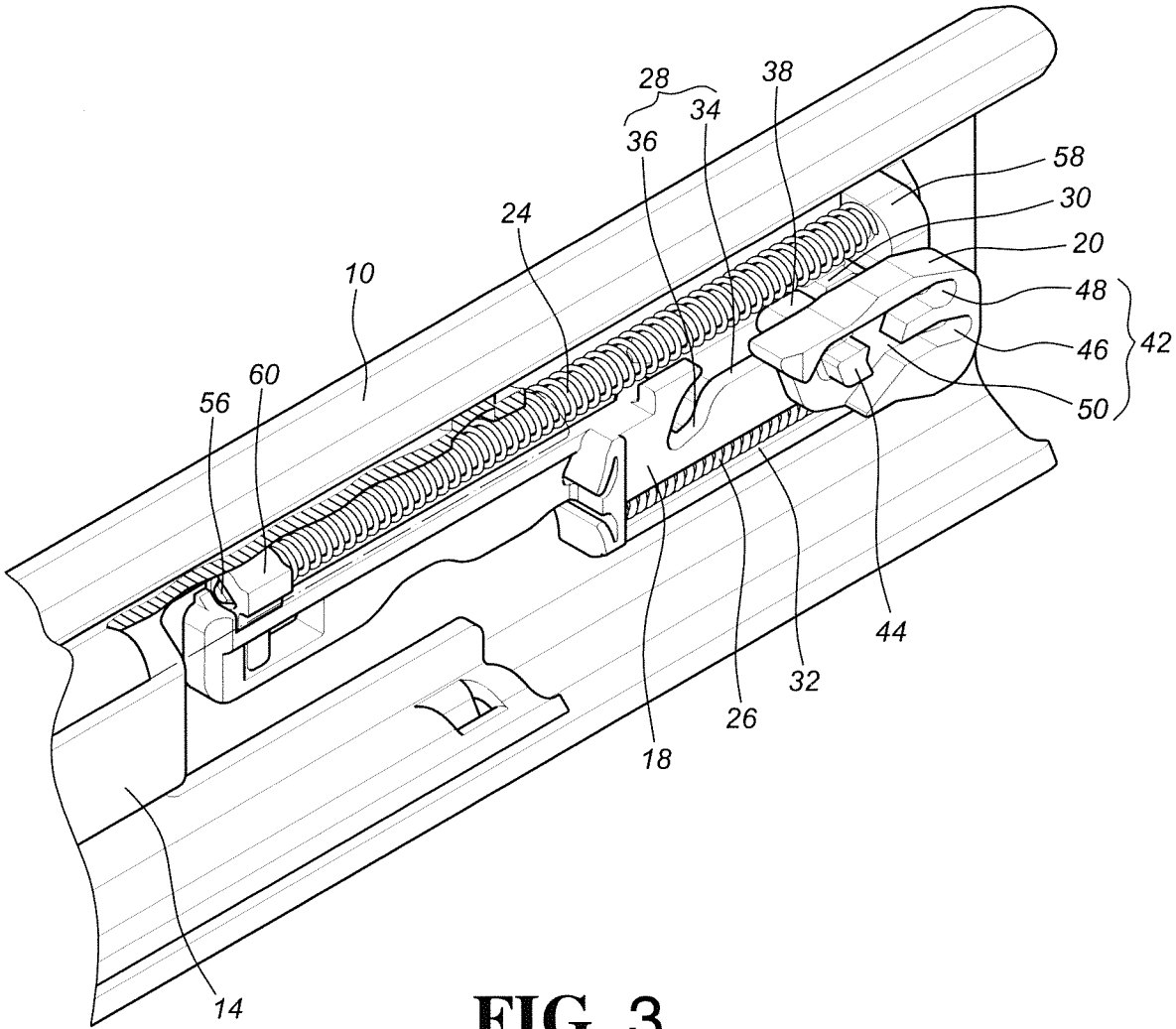
FIG. 3 shows the connection relationship of the parts of the opening mechanism of the present invention.

Referring to FIG. 2, an opening mechanism 16 for the slide assembly of the present invention comprises a fixing member 18, a movable member 20, a locking member 22, a first resilient member 24 and a second resilient member 26. As shown in FIG. 3, the fixing member 18 is fixed to the first rail 10 and has a guide portion 28, a stop 30 and a room 32. The guide portion 28 has a longitudinal guide section 34 and a bent section 36 which is located at the front end of the longitudinal guide section 34. The stop 30 is located at the rear end of the longitudinal guide section 34. The room 32 is substantially parallel to the longitudinal guide section 34.

The movable member 20 is movably connected to the fixing member 18 and has a first leg 38, a second leg 40, a guide path 42 and an engaging portion 44. The first leg 38 and the second leg 40 are located at the bottom of the movable member 20 as shown in FIG. 2, and the guide path 42 and the engaging portion 44 are located on the top of the movable member 20. The first leg 38 slidably contacts the guide portion 28 of the fixing member 18. The second leg 40 extends into the room 32 of the fixing member 18. The guide path 42 has a first longitudinal groove 46, a second longitudinal groove 48 and a passage 50. The first longitudinal groove 46 and the second longitudinal groove 48 are located on two sides of the engaging portion 44. The passage 50 communicates with the first and second longitudinal grooves 46 and 48 and is located corresponding to the engaging portion 44.

The locking member 22 is pivotably connected to the second rail 12 by a pin 52. The locking member 22 has a locking portion 54 which is engaged with the engaging portion 44 of the movable member 20 when the second rail 12 is located at a retracted position relative to the first rail 10.

The first resilient member 24 provides a force in a first direction and is applied to the third rail 14 which is capable of popping out relative to the first rail 10. In a preferable embodiment, the first resilient member 24 is mounted to a fixing rod 56, and two ends of the first resilient member 24 respectively contact a head 58 of the fixing rod 56 and a push member 60 mounted to the fixing rod 56. The push member 60 is slidably connected to the fixing member 18 and contacts the third rail 14.

The second resilient member 26 provides a force in a second direction and is applied to the movable member 20. The second direction is opposite to the first direction so that the movable member 20 is capable of returning to its original position relative to the fixing member 18. The force of the second resilient member 26 is larger than that of the first resilient member 24. In a preferable embodiment, the second resilient member 26 is located in the room 32 of the fixing member 18. Two ends of the second resilient member 26 respectively contact an inner wall of the room 32 and the second leg 40 of the movable member 20. The movable member 20 contacts the stop 30 of the fixing member 18 by the force of the second resilient member 26.

Figure 4:
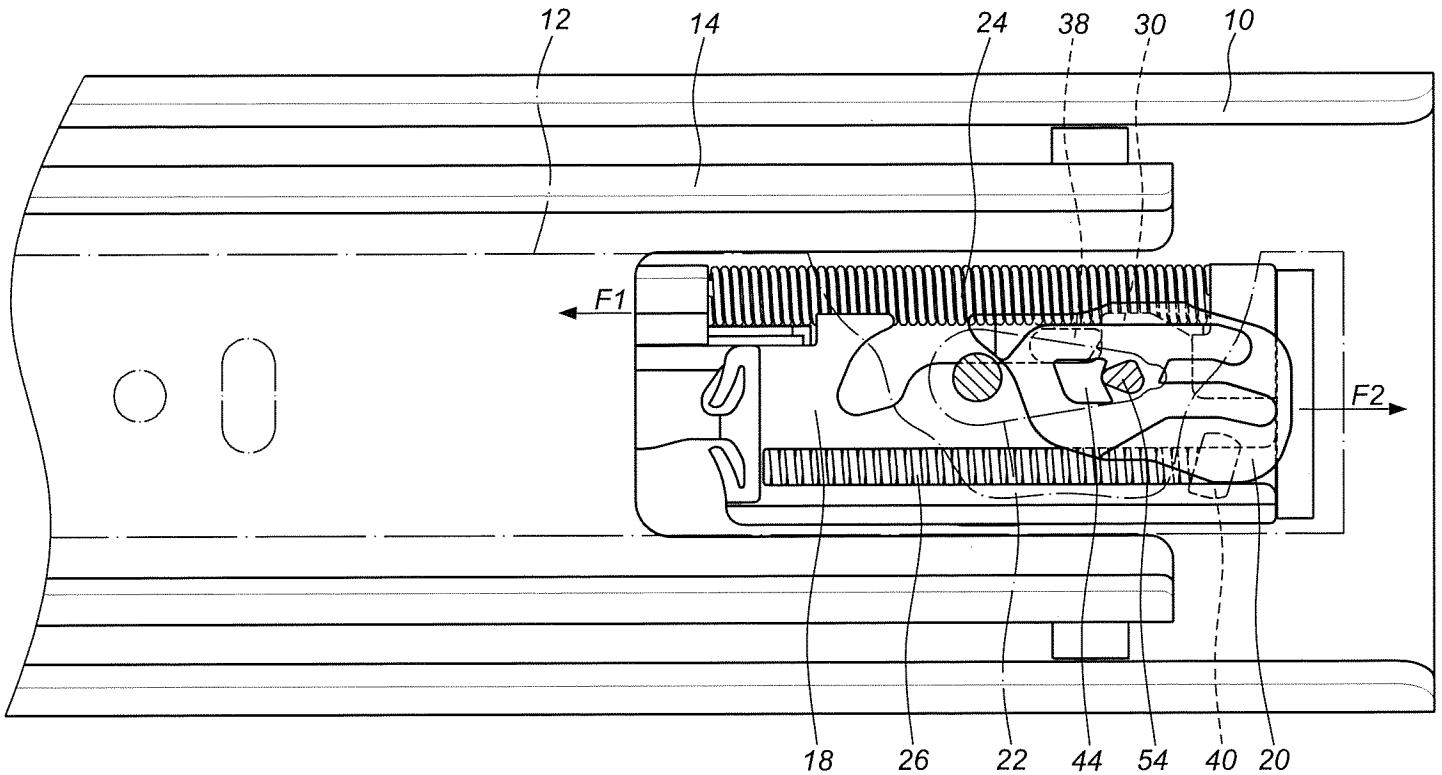
FIG. 4 shows the connection relationship of the parts of the opening mechanism of the present invention when the slide assembly is in a retracted status.

As shown in FIG. 4, the second rail 12 is located at the retracted position relative to the first rail 10, and the locking portion 54 of the locking member 22 is engaged with the engaging portion 44 of the movable member 20 on the first rail 10. In this status, the first resilient member 24 provides the force in the first direction F1 to the third rail 14 which stores a force for popping outward relative to the first rail 10. The second resilient member 26 provides the force in the second direction F2 to the movable member 20 which contacts the stop 30 of the fixing member 18 by the first leg 38.

Figure 5:
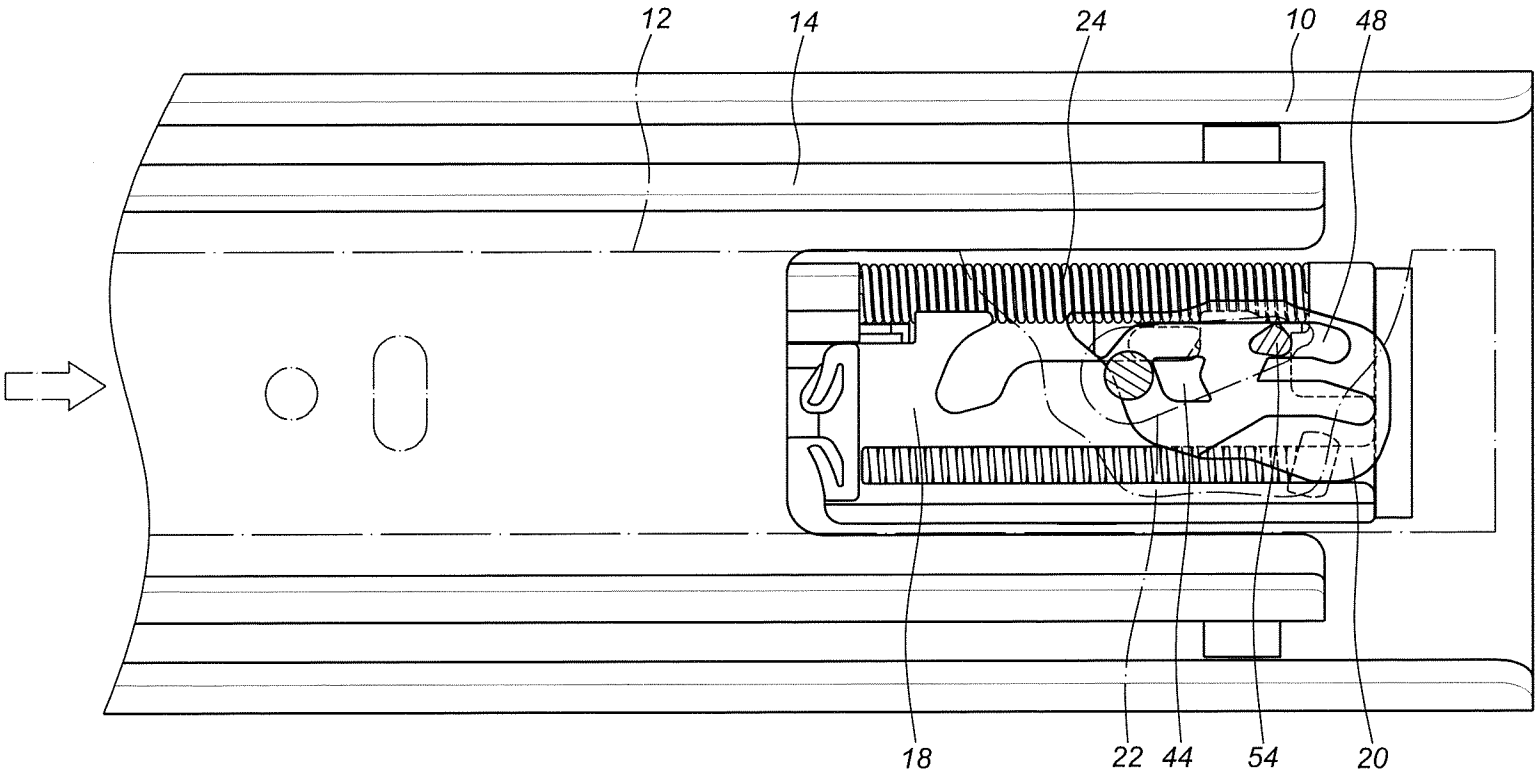
FIG. 5 shows the opening mechanism of the present invention when the slide assembly is opened by a push force.

As shown in FIG. 5, when a user operates the slide assembly in a normal way, a force as shown by the arrow head to the second rail 12, the locking portion 54 of the locking member 22 is disengaged from the engaging portion 44 of the movable member 20, and moves to the second longitudinal groove 48 of the movable member 20. The third rail 14 is released by the force of the first resilient member 24 so that the second and third rails 12 and 14 are opened relative to the first rail 10. In the meanwhile, the locking portion 54 of the locking member 22 is removed from the second longitudinal groove 48 of the movable member 20 so that the slide assembly is opened by a push force.

Figure 6:
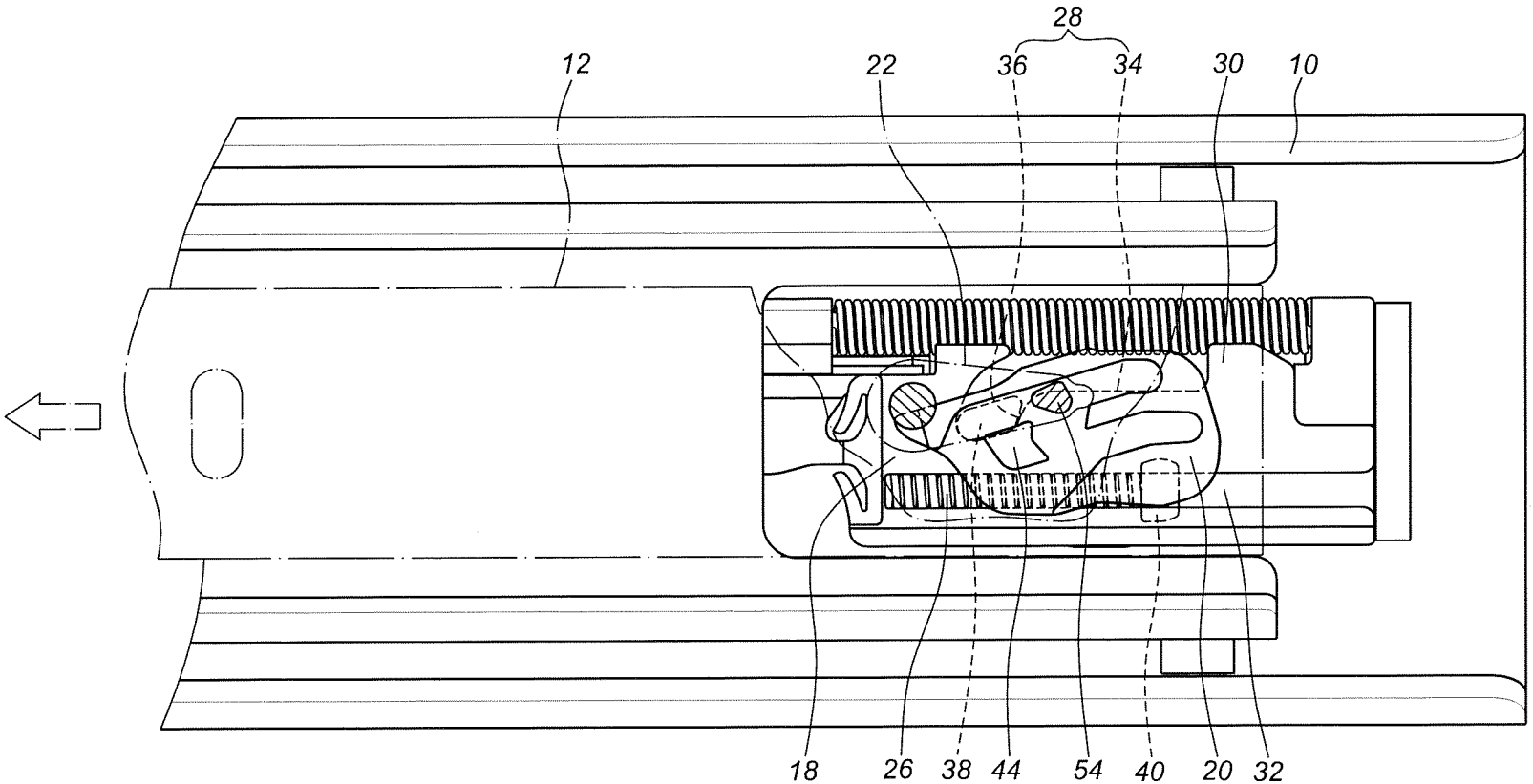
FIG. 6 shows the opening mechanism of the present invention when the slide assembly is pulled by force.
Figure 7:
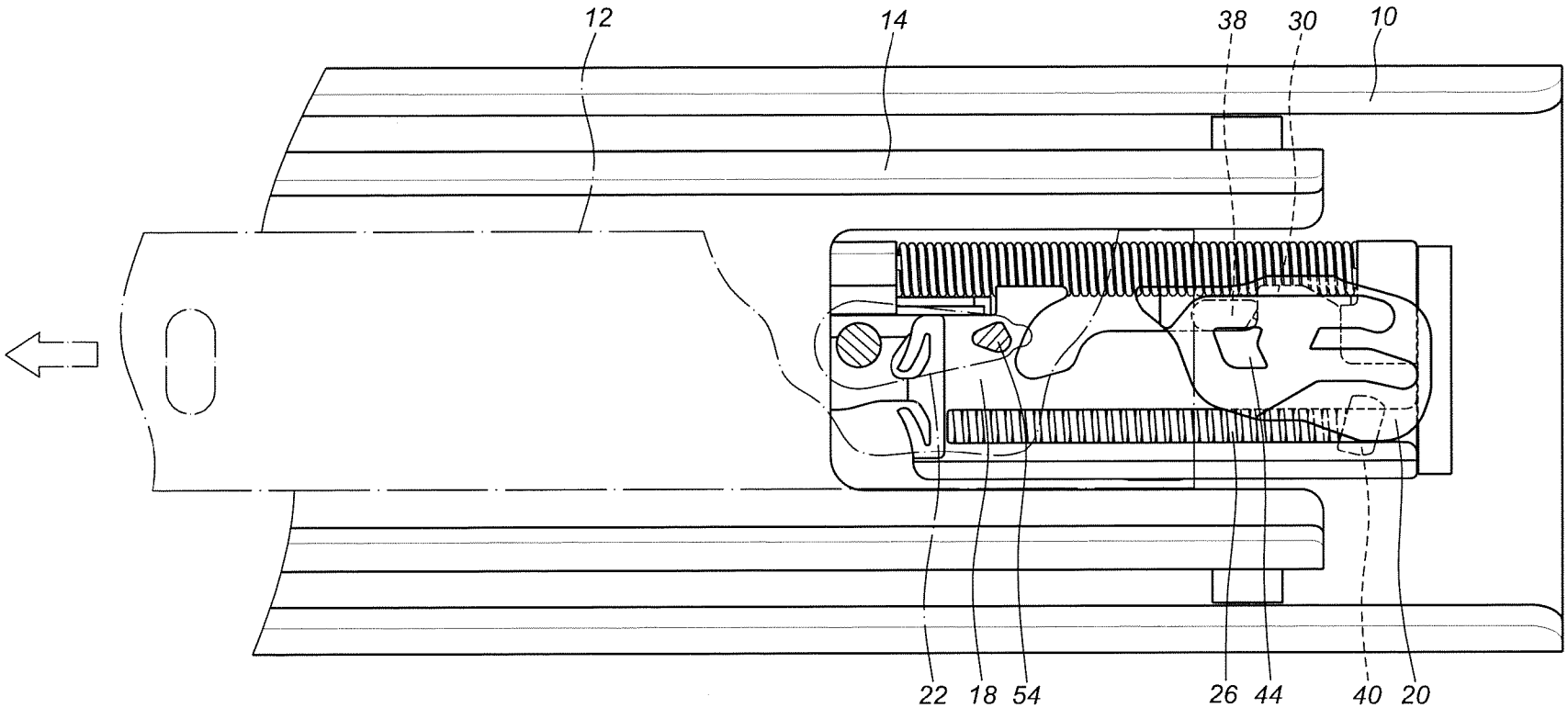
FIG. 7 shows that the movable member moves back after the slide assembly is opened by force.

As shown in FIG. 6, when the second rail 12 is forcibly pulled out relative to the first rail 10 as shown in the arrow head, because the engaging portion 44 of the movable member 20 is engaged with the locking portion 54 of the locking member 22, the movable member 20 is moved by the locking member 22 and the second rail 12. The first leg 38 of the movable member 20 moves along the longitudinal guide section 34 of the guide portion 28 of the fixing member 18. The second leg 40 of the movable member 20 moves in the room 32 of the fixing member 18 so as to push the second resilient member 26. When the movable member 20 is moved to the front end of the longitudinal guide section 34, the first leg 38 slides in the bent section 36 at the front end of the longitudinal guide section 34 and pivots at an angle so that the locking portion 54 is disengaged from the engaging portion 44. In the meanwhile, the second resilient member 26 generates a compression force which is applied to the movable member 20 so that the movable member 20 is pushed back by the force of the second resilient member 26 and contacts the stop 30 of the fixing member 18, as shown in FIG. 7. And then, the second rail 12 can be further pulled relative to the first rail 10 to a distance by the assistance of the third rail 14.

When the slide assembly is pulled by force, the movable member 20 can be disengaged from a locked status in response to the force applied, so that the parts of the slide assembly can be protected. Besides, the movable member 20 is disengaged when the movable member 20 is pulled a distance relative to the fixing member 18, so that when the exterior force is resulted from impact, tapping or vibration, which cannot overcome the force that is applied to the movable member 20 from the second resilient member 26, and the exterior force cannot move the movable member 20 for a distance, the second rail 12 is still kept as the closed status relative to the first rail 10. This prevents a sudden opening force applied to the slide assembly so that the slide assembly has a stable closed status.

Figure 8:
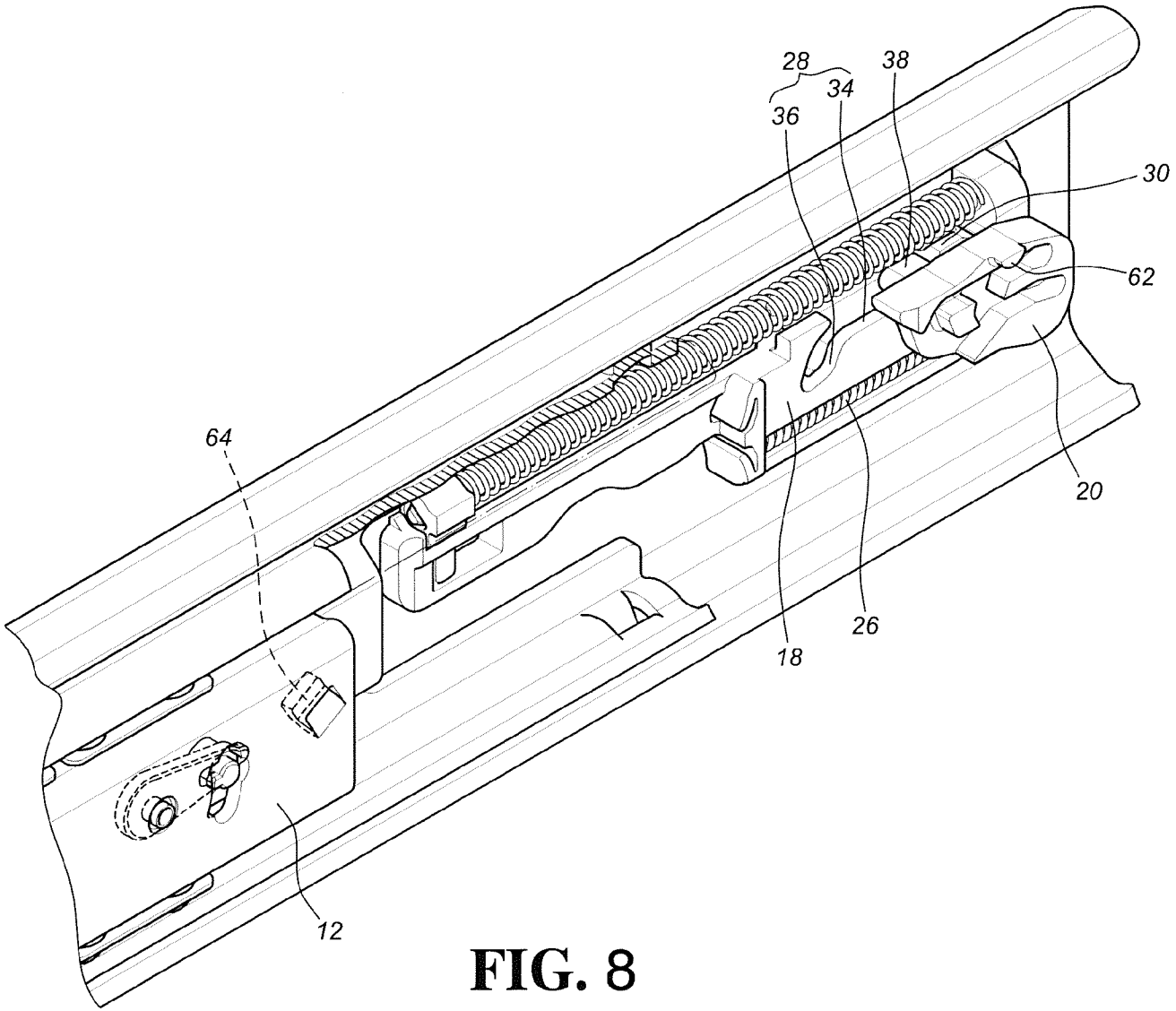
FIG. 8 shows that the movable member has a protrusion and the second rail has a contact portion.
Figure 9:
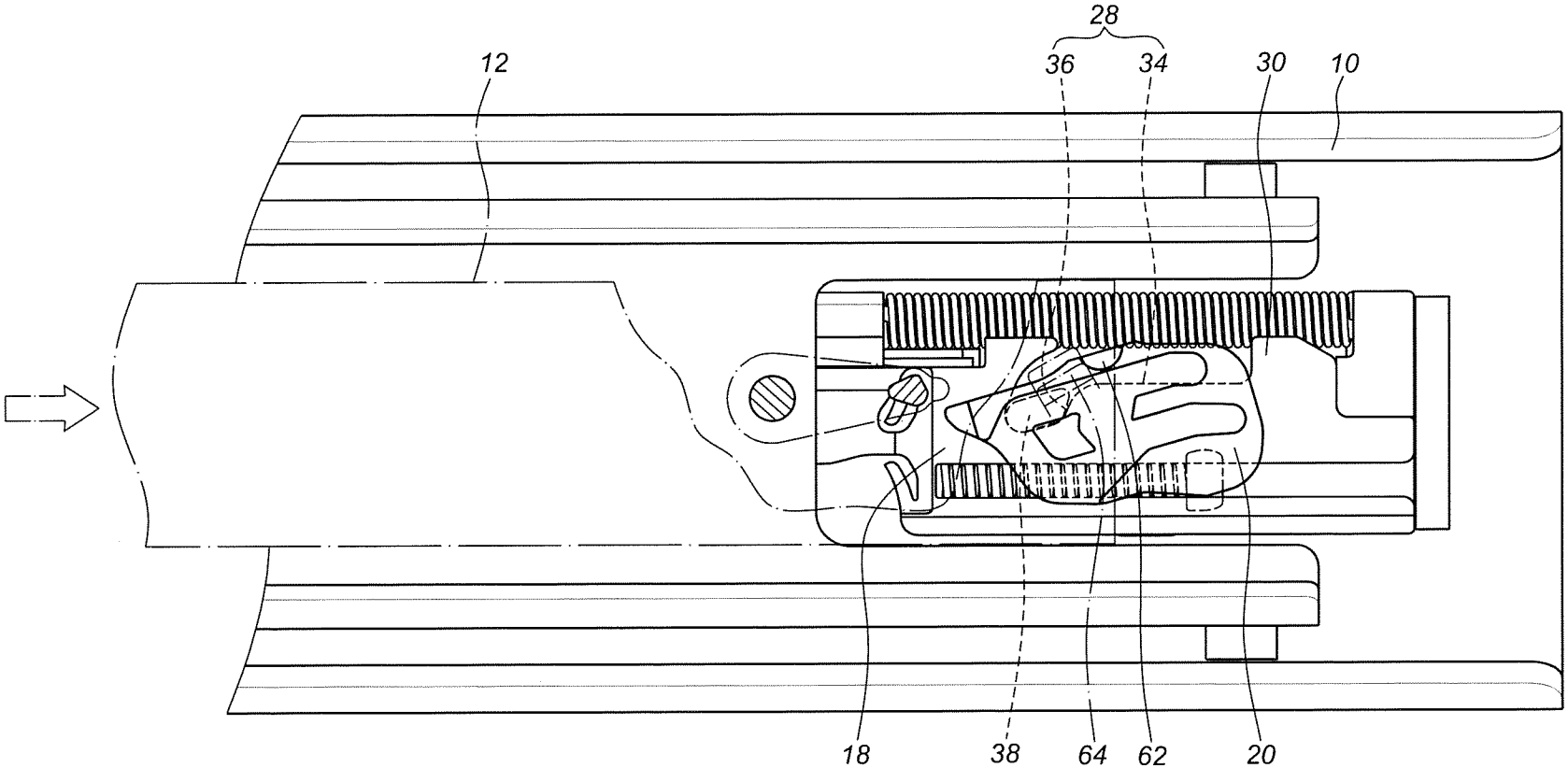
FIG. 9 shows that the movable member is moved to contact the fixing member, and the contact portion contacts the protrusion.

As shown in FIG. 8, the movable member 20 has a protrusion 62 and the second rail 12 has a contact portion 64 which is located corresponding to the protrusion 62. As shown in FIG. 9, the movement of the movable member 20 along the guide portion 28 of the fixing member 18 results in another situation. The first leg 38 of the movable member 20 slides in the bent section 36 at the front end of the longitudinal guide section 34 and pivots at an angle, and the movable member 20 stops at the bent section 36. When the second rail 12 is retracted into the first rail 10 again, in order to disengage the first leg 38 of the movable member 20 from the bent section 36 of the fixing member 18, the contact portion 64 pushes the protrusion 62 to move the movable member 20 to disengage the first leg 38 from the bent section 36 of the fixing member 18. The second resilient member 26 generates a compression force which is applied to the movable member 20 so that the movable member 20 is pushed back and the first leg 38 contacts the stop 30 of the fixing member 18.

Figure 10:
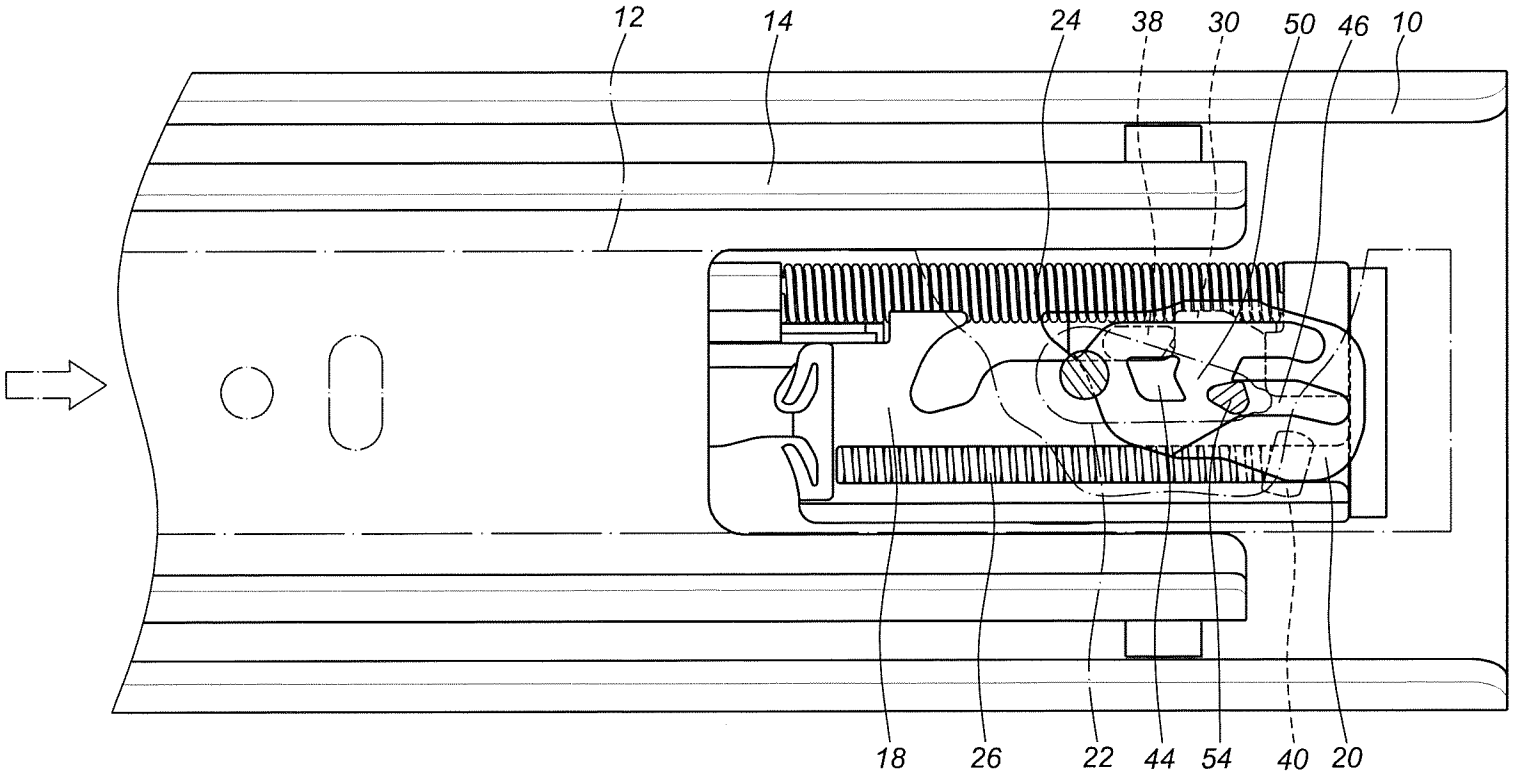
FIG. 10 shows that the movable member moves back to its original position when the slide assembly is pushed to its retracted position.

FIG. 10 shows that the second rail 12 is pushed back relative to the first rail 10 and the first leg 38 of the movable member 20 contacts the stop 30 of the fixing member 18 to return and position the movable member 20. The locking portion 54 of the locking member 22 enters into the first longitudinal groove 46 of the movable member 20. When the push force is released, by the force of the first resilient member 24, the locking portion 54 of the locking member 22 is removed from the first longitudinal groove 46 and enters into the passage 50 of the movable member 20. The engaging portion 54 is engaged with the engaging portion 44 of the movable member 20 again as shown in FIG. 4.

It is noted that, if the slide assembly of the present invention is two-section slide assembly, the first resilient member 24 directly applies to the second rail 12 (not shown) so that the two-section slide assembly can be kept at the retracted position. When pushing the second rail 12 relative to the first rail 10, the locking portion 54 of the locking member 22 is disengaged from the engaging portion 44 of the movable member 20 and the second rail 12 pops out relative to the first rail 10 by the force of the first resilient member 24.

The present invention relates to an opening mechanism for a slide assembly, wherein the opening mechanism protects the parts of the slide assembly from being damaged when the slide assembly is forcibly opened from its retracted position. The life of use is prolonged and the quality of the slide assembly is stable. The slide assembly can be used to the drawers for bearing heavy load in furniture, cabinet or the like, so as to prevent damage or injury to the parts and the users when the slide assembly is forcibly opened.

While we have shown and described the embodiment in accordance with the present invention, it should be clear to those skilled in the art that further embodiments may be made without departing from the scope of the present invention.

What is claimed is:

1. An opening mechanism of a slide assembly, comprising:

a fixing member fixed to a first rail and having a guide portion, a stop and a room, the guide portion having a longitudinal guide section and a bent section which is located at a front end of the longitudinal guide section, wherein the stop located at a rear end of the longitudinal guide section, and the room substantially parallel to the longitudinal guide section;

a movable member movably connected to the fixing member and having a first leg, a second leg, a guide path and an engaging portion, the first leg slidably contacting the guide portion of the fixing member, the second leg extending into the room of the fixing member, the guide path having a first longitudinal groove, a second longitudinal groove and a passage, wherein the first longitudinal groove and the second longitudinal groove located on two sides of the engaging portion, and the passage communicates with the first and second longitudinal grooves and located corresponding to the engaging portion;

a locking member pivotably connected to a second rail which is longitudinally and slidably movable relative to the first rail, the locking member having a locking portion, the locking portion being engaged with the engaging portion of the movable member when the second rail is located at a retracted position relative to the first rail;

a first resilient member providing a compression force in a first direction and applied to a third rail which is slidably connected between the first and second rails;

a second resilient member providing a force in a second direction and applied to the movable member, the second direction being opposite to the first direction, and the force of the second resilient member being larger than that of the first resilient member;

wherein when the locking portion of the locking member is engaged with the engaging portion of the movable member, the first resilient member provides the force in the first direction to the third rail which stores a force for popping outward relative to the first rail, the second resilient member providing the force in the second direction to the movable member which contacts the stop of the fixing member, and wherein when the second rail is forcibly pulled out relative to the first rail, the first leg of the movable member is moved along the longitudinal guide section of the guide portion of the fixing member, and the second leg of the movable member moves in the room of the fixing member so as to push the second resilient member, and when the movable member is moved to the front end of the longitudinal guide section, the first leg slides in the bent section at the front end of the longitudinal guide section and pivots at an angle so that the locking portion of the locking member is disengaged from the engaging portion of the movable member, and the second resilient member generates the compression force which is applied to the movable member.

2. The opening mechanism as claimed in claim 1, wherein the first leg and the second leg are located at a bottom of the movable member, and the guide path and the engaging portion are located on a top of the movable member.

3. The opening mechanism as claimed in claim 1, wherein the first resilient member is mounted to a fixing rod, two ends of the first resilient member respectively contact a head of the fixing rod and a push member mounted to the fixing rod, and the push member is slidably connected to the fixing member and contacts the third rail.

4. The opening mechanism as claimed in claim 1, wherein the second resilient member is located in the room of the fixing member, two ends of the second resilient member respectively contact an inner wall of the room and the second leg of the movable member, and the movable member contacts the stop of the fixing member by the force of the second resilient member.

5. The opening mechanism as claimed in claim 1, wherein the movable member has a protrusion and the second rail has a contact portion which is located corresponding to the protrusion, and when the protrusion is pushed by the contact portion, the movable member is moved and the first leg is disengaged from the bent section of the fixing member.

* * * * *